United States Patent [19]

Kottelman

[11] Patent Number: 4,620,183

[45] Date of Patent: Oct. 28, 1986

[54] ALARM ASSEMBLY FOR JEWELERY-TYPE DISPLAY CASE

[76] Inventor: Sanders Kottelman, 777-C NW. 29th Ave., DelRay Beach, Fla. 33445

[21] Appl. No.: 579,416

[22] Filed: Feb. 13, 1984

[51] Int. Cl.[4] ..... G08B 13/14

[52] U.S. Cl. ..... 340/568; 340/652

[58] Field of Search ..... 340/568, 570, 652, 572; 312/114

[56] References Cited

U.S. PATENT DOCUMENTS

| | | | |
|---|---|---|---|
| 3,668,681 | 6/1972 | Kaplan | 340/537 |
| 4,155,457 | 5/1979 | Wilbert | 340/568 X |
| 4,172,254 | 10/1979 | Vermillion | 340/568 |

*Primary Examiner*—James L. Rowland
*Assistant Examiner*—Brian R. Tumm
*Attorney, Agent, or Firm*—John Cyril Malloy

[57] ABSTRACT

An alarm system and assembly including one or more base elements specifically structured for positioning on the interior of a jewelery-type display case and including a circuit means having an extended conductor interconnected in series with an alarm assembly and power source and further interconnected with a plurality of tray elements mounted on an exposed display platform to the extent that movement or actual removal of any of the tray elements will cause a break in the circuitry through separation of first and second contact pairs associated with the conductor means which in turn causes an activation of the signal assembly so as to provide a warning to attendant or merchants in the vicinity of the display case. Further, the signal assembly will be activated upon relative movement and/or displacement of the plurality of base elements independent of any displacement of tray elements.

15 Claims, 8 Drawing Figures

ALARM ASSEMBLY FOR JEWELERY-TYPE DISPLAY CASE

BACKGROUND OF THE INVENTION

1. Field of the Invention

The present invention is directed towards an alarm system designed to protect the "interior" of a jewelry-type display case to the extent that unauthorized removal of tray elements or like display carriers, bearing jewelry or like articles being protected, will cause a disruption of current flow in predetermined and positioned circuitry and activation of an alarm assembly which will inform attendants or merchants associated with the display case that such unauthorized removal is being attempted.

2. Description of the Prior Art

Alarm systems have for many years been adapted and designed for specific areas of application. In addition to rather large and often times complex systems which are intended to prevent unauthorized entry into residential or commercial dwellings, modern day electronics have made possible the adaptation of such systems for much smaller and limited applications. However, such limited applications are still of vast importance particularly to merchants who operate retail or like consumer outlets where vast numbers of the consuming public are allowed in the vicinity of valued articles of merchandise.

In the area of protecting jewelery and like relatively small and highly valued articles, the prior art includes numerous alarm systems associated directly with the protection of display cases. However, the vast majority of such systems are primarily directed towards the prevention and/or signalling of merchants when unauthorized entry into the interior of such display cases is attempted. Therefore, such prior art alarm systems are associated directly in combination with such a display case itself or alternately are positioned in surrounding areas to such display cases such that the presence or movement of an unauthorized person into a restricted area, such as behind a display case, is immediately apparent to the merchant. Professional thieves, however, are aware of such prior art devices and have devised many methods of readily overcoming such devices to the extent that undetected entry into the interior of display cases and access to the articles contained therein are not uncommon.

Such prior art devices are disclosed in the following U.S. Pat. Nos.: 4,274,088; 4,293,852; 4,132,987; 4,155,457; and 3,459,424.

Based on the problems existing in the industry, it is generally accepted that there is a need for an alarm system which is readily adaptable to existing jewelery-type display cases without extensive modification thereto and further, wherein such a preferred system would be capable of signalling merchants or attendance of such cases even after unauthorized entry has been accomplished but prior to actual removal of the valued articles from the casing and/or surrounding premises. Further, such a preferred alarm system should be structured so as to adapt existing display cases with a minimal of additional expense but should be sufficiently reliable in construction and design so as to detect even the slightest displacement of jewelery display trays or supporting display platforms.

SUMMARY OF THE INVENTION

The present invention is directed towards an alarm system primarily designed for use in the protection of removal of jewelery carrier or display trays from display platforms and/or the displacement of supporting base elements from one another and/or the interior of a jewelery display case even after undetected, unauthorized entry to such interior has been accomplished. Therefore, the subject alarm system will prevent the theft of a plurality of jewelery articles mounted on one or more carrier tray elements or even an entire base element, which is the primary goal of professional thieves and generally the first concern of merchants displaying and selling such jewelery-type articles to the consuming public.

More specifically, in the present invention, a base means preferably including a plurality of adjacently positioned base elements are dimensioned and structured to be mounted on the interior of a jewelery-type display case. In such manner, jewelery and like articles of value are displayed for viewing in a substantially conventional fashion and utilizing jewelery-type display cases of substantially conventional design and structure. Each of the base elements includes a substrate positioned to support thereon a display platform means which defines the exposed surface of the base element and further, which may be finished in a velvet or material similar in appearance and texture so as to add to the overally aesthetic appearance when displaying valued articles. A plurality of tray elements may further be mounted on the exposed surface of the display platform means but are structured to include a depending plug secured to the undersurface thereof. Each plug of a plurality of specifically oriented tray elements is preferably correspondingly dimensioned and configured so as to fit, interchangeably, into one of a plurality of sockets in the form of apertures extending through the display platform means and into communicating relation with the substrate.

A circuit means is provided which includes an elongated conductor, interconnecting in series a plurality of conductor segments. Each conductor segment is secured to and extends along the undersurface of each plug of each tray element. Therefore, when each of the tray elements are mounted in one of each of the plurality of sockets formed in the base element, the conductor means is complete and forms a continuous path of current flow to the extent that each of the tray elements are interconnected in series with one another through interconnection of each of the aforementioned conductor segments with the primary conductor means itself. Further, the circuit means includes a power source and signal assembly also located in series with one another and with the conductor means and individual conductor segments of the tray elements. By virtue of such arrangement, removal of any of the tray elements from the socket in which they are initially placed causes a disruption of current flow through the conductor means and remaining interconnected conductor segments. This in turn causes activation of the signal assembly through operation of proper solenoid switching structure and such activation indicates to the attendant or merchant in the vicinity of the display case that unauthorized removal of one of the tray elements or displacement of an entire base element is occurring.

Based on the above, articles of value such as but not limited to jewelery articles, being displayed on the interior of a display case are protected even if unauthorized entry has been accomplished into the interior of such a jewelery display case.

The invention accordingly comprises the features of construction, combination of elements and arrangements of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference characters refer to like parts throughout the several views of the drawings.

DETAILED DESCRIPTION OF THE PREFERRED EMBODIMENT

Figure 8:
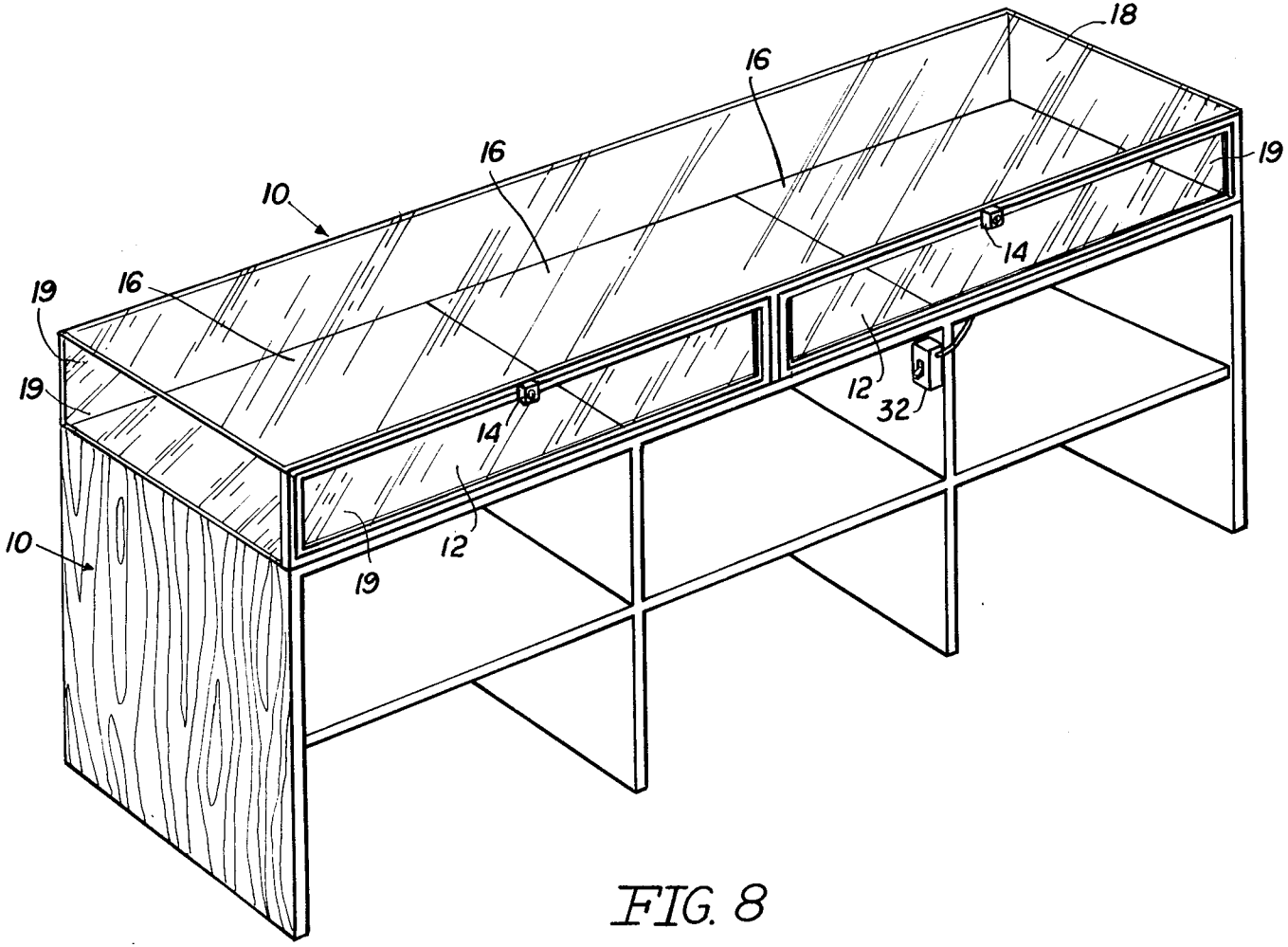
FIG. 8 is an isometric view of a jewelery display case with the plurality of platform elements represented in FIG. 1 mounted on the interior thereof.

With reference to FIG. 8, the present invention is primarily designed for use with a display case generally indicated as 10 and structured to display articles of value and which are broadly known as jewelery-type display cases. As shown in FIG. 8, the rear of the display case 10 includes a plurality of doors 12 each including lock means 14 secured thereto so as to prevent unauthorized access through the doors 12 to the interior of the display case. Display platform means generally indicated as 16 are mounted on the interior of the display case and are structured to include a plurality of tray elements 17 (FIGS. 1 and 2) which are structured to hold a variety of articles, such as jewelery, in clear view on the exposed surface of the display platform means 16. Viewing of the articles of value without access thereto is provided through transparent material plates such as glass or the like 18 wherein surrounding front, side, and rear plates 19 may also be transparent to enhance the viewing of such jewelery or valued articles.

Figure 1:
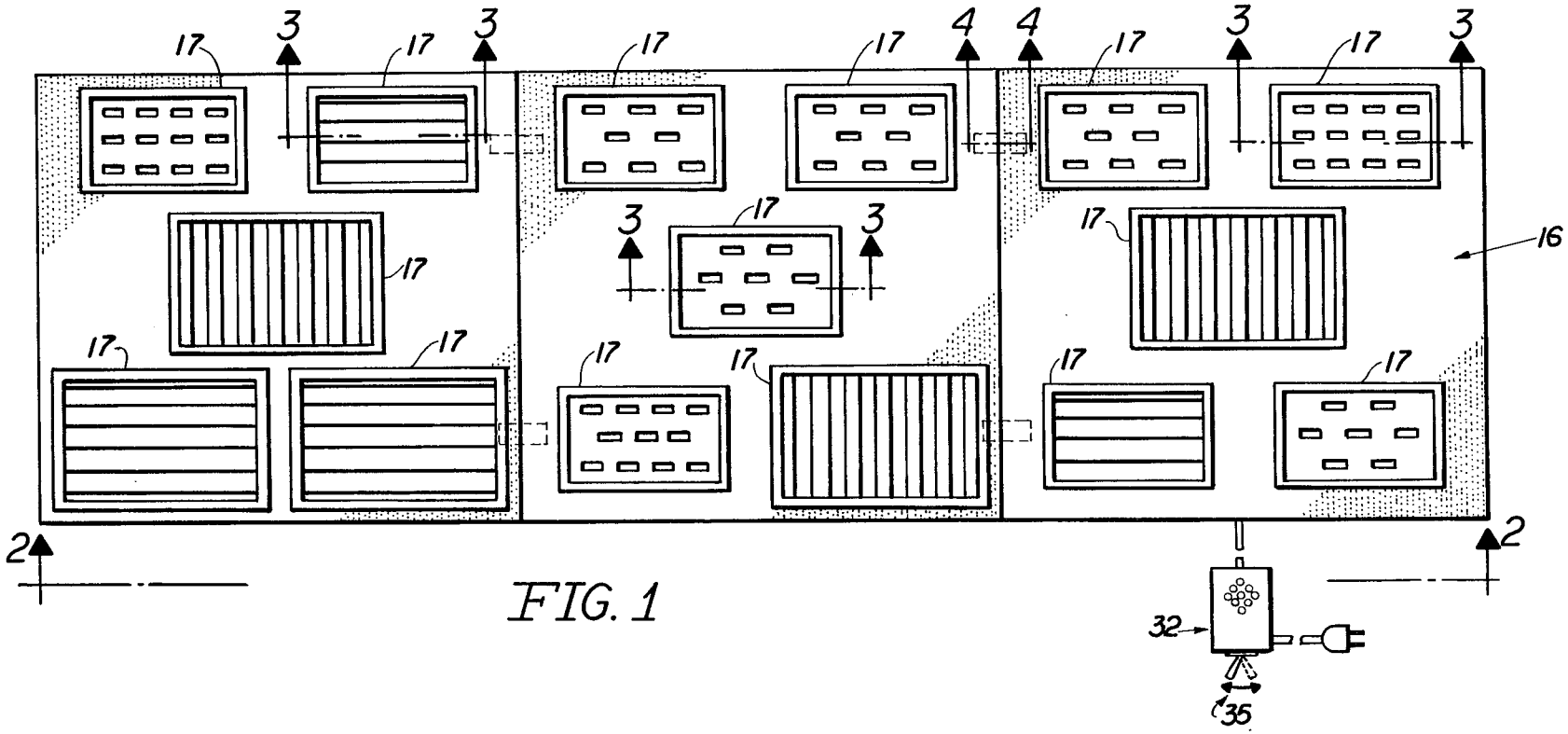
FIG. 1 is a top plan view of a plurality of base elements disposed in interconnected relation to one another with jewelery carrier trays mounted thereon.
Figure 2:
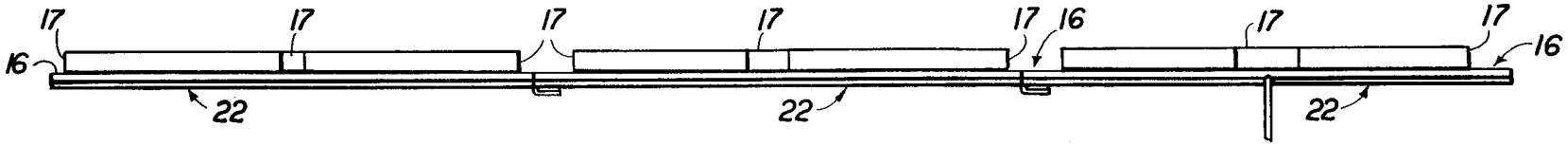
FIG. 2 is a side view of the embodiment of FIG. 1.
Figure 5:
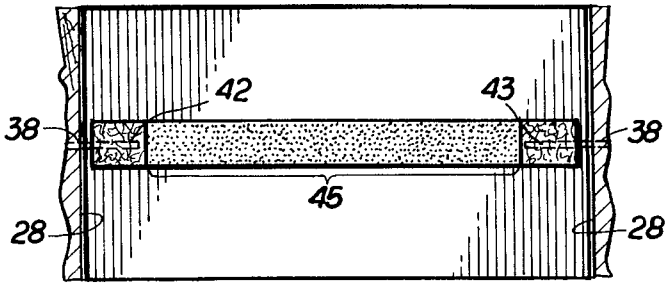
FIG. 5 is a top plan view along line 5—5 of FIG. 3 showing details of a conductor means associated with the circuit means of the present invention.
Figure 6:
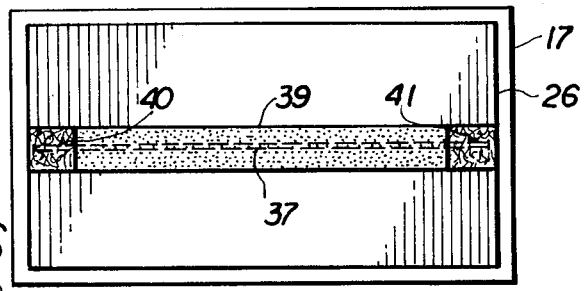
FIG. 6 is a bottom view along line 6—6 of FIG. 3 showing structural details of conductor segments associated with the undersurface of the individual carrier tray elements.
Figure 4:
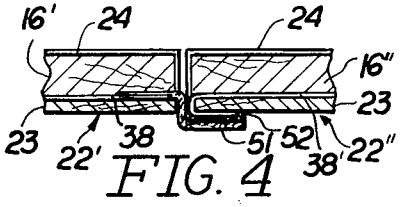
FIG. 4 is a sectional view in partial cutaway along line 4—4 of FIG. 1.
Figure 3:
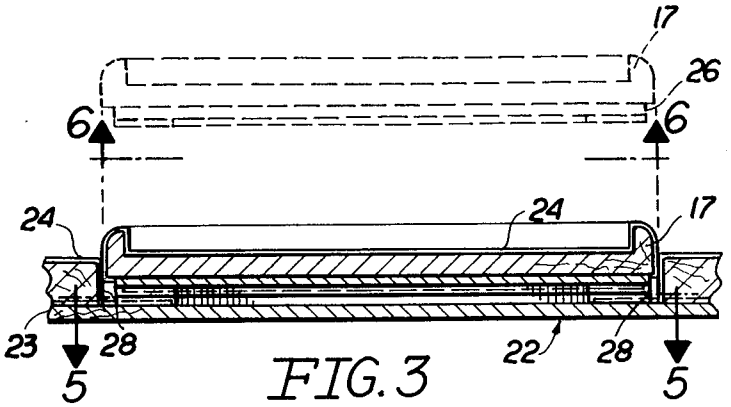
FIG. 3 is a sectional view in partial cutaway along line 3—3 of FIG. 1 with one tray element being removed from a base element on which it has been mounted.

With reference to FIGS. 1 and 2, jewelery or valued articles (not specifically shown) are mounted or carried by a plurality of tray elements 17 which are specifically structured in a variety of configurations to hold various types of jewelery such as rings, watches, bracelets, chains, etc. The display platform means 16 may define part of a base means which itself may include one or more base elements 22. Each base element 22 (see FIGS. 3 and 4) includes a substrate 23 disposed in supporting relation to the display platforms 16' of each display platform means 16. In addition, the exposed surface of both the tray elements 17 and the display platforms 16' may be covered with a velvet or similar type material 24 which adds to the overall asesthetic appearance of and at least partially defines the exposed surface of the display platform means 16 and tray element 17.

As will be explained in greater detail hereinafter and with specific reference to FIGS. 3 through 6, each of the tray elements 17 comprises a plug 26 structured in depending relation to the undersurface thereof and specifically structured to substantially communicate with the substrate 23 through individual ones of a plurality of sockets 28 formed therein. Each of the sockets, in a preferred embodiment, may be arranged in a predetermined alignment with one another so as to dispose a plurality of tray elements 17 in an efficient and aesthetically pleasing array over the exposed surface of the display platform means 16. The individual sockets 28 are preferably of a common dimension and configuration which will allow the placement of any tray element 17 or more specifically the plug 26 secured thereto in mating engagement with the individual sockets 28.

Figure 7:
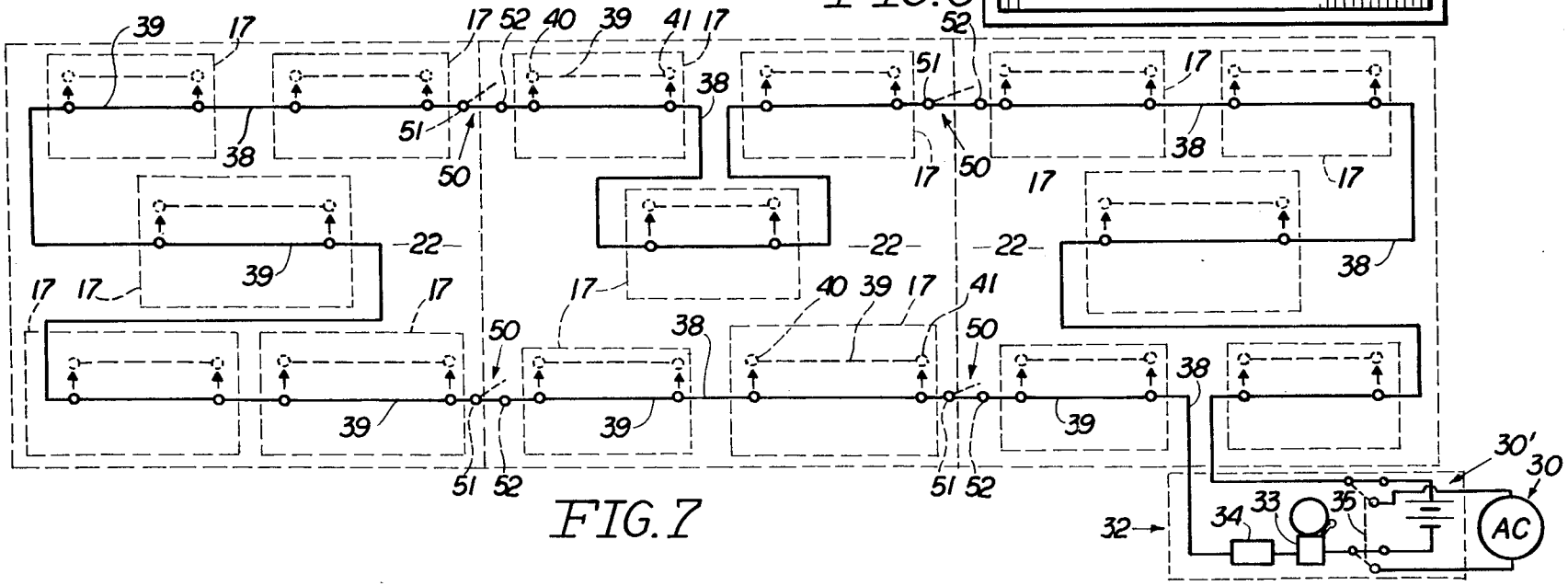
FIG. 7 is a schematic representation of the circuit means of the present invention.

Operation of the subject alarm system will be made apparent through explanation of the circuitry associated therewith and represented schematically in FIG. 7. Such circuitry includes a power supply generally indicated as 30 which may be either a conventional a.c. power support or alternately a self-contained d.c. type battery. Further, a power source such as 30' may be in the form of d.c. battery and selectively interconnected to or be a part of a signal assembly generally indicated as 32. Such signal assembly may include a signal means 33 which may be either visual or audio in nature and which may be activated, as explained in greater detail hereinafter, by a solenoid type activating switching means 34 also forming part of the overall signalling assembly 32. The signalling assembly may include an on/off and current regulating switch means 35 serving to direct activating power from power supply 30 to the signal assembly 32 and/or maintain a constant current flow, once activated, through power source 30' to the signal structure 33 and interconnected and associated solenoid operating switch 34. A conductor means 38 is provided in series interconnection with the signal assembly 32 and power supply 30 and/or 30' as well as each of the individual tray elements 17 as well as the base elements 22. For purposes of clarity, the individual base elements 22 and the tray elements 17 are represented in broken lines in FIG. 7.

With specific reference to FIGS. 3 through 7, the primary conductor means 38 has an elongated configuration and extends in series interconnection between each of the tray elements 17. Further, conductor segments 39 are secured to the undersurface of each plug 26 wherein each conductor segment 39 comprises a first contact pair 40, 41 defined by such individual contacts 40 and 41 located at opposite ends of the conductor segment 39. A conductor element 37 extends between and in current interconnection with each of the individual contacts 40 and 41 of the contact pair 40, 41. Such first contact pair 40, 41 is designed to be brought into engagement and mating contact with a second contact pair 42, 43 wherein the individual contacts 42 and 43 are located at opposite ends of each socket 28 and define a gap 45 (FIG. 5) in the primary conductor means 28.

This gap 45 is filled when the contacts 40 and 41 of the first contact pair 40, 41 are brought into mating engagement with the correspondingly positioned contacts 42 and 43 of the second contact pair 42, 43. This occurs when the plug 26 is fit in mating engagement on the interior of the individual sockets 28. Therefore, when all of the first contact pairs 40, 41 and accordingly, the conductor segments 39 are brought into mating interconnected engagment with the second contact pair 42, 43 through placement of one tray 17 in one socket, the entire primary conductor means 38 is completed and current flows in series relation throughout the entire conductor 38 across the individual gaps 45 and further in series with the alarm assembly 32 and power supply 30 and/or 30'. However, a removal of any of the tray elements 17 from their appropriately positioned sockets 28 will cause disengagement between first contact pair 40, 41 and second contact pair 42, 43 and a breaking of current flow through the primary conductor means 38. This in turn will cause activation of solenoid activating switch 34 and alarm structure 33 thereby giving warning to the attendant or merchant watching over a given display case.

In addition, the circuit means of the present invention includes electrical interconnection between each of the adjacently positioned base plates as at 50 (FIG. 7) through the provision of first and second base contact pairs. More specifically and with reference to FIGS. 4 and 7, base element 22' includes a pair of tab elements 51 extending outwardly from one lateral edge or side of the substrate 23 into mating engagement with a pair of pads 52. Such pads and tabs respectively define conductive first base contact pairs 51, 51 and second base contact pairs 52, 52. Each of these elements is connected to the primary conductor means 38 such that when disengagement between the interconnected base contact pairs 51, 51 and 52, 52 occurs, a break in current flow occurs through the primary conductor 38 thereby serving to activate the signal assembly 32 in the manner set forth above. Accordingly, the subject alarm system is structured to activate an audio or visual alarm when either any of the tray elements 17 is displayed and/or any of the base elements 22 are displaced or removed from one another.

Further structural features of the present invention include the provision of attachment means associated directly with each of the contact pairs 40, 41; 42, 43; 51, 51, and 52, 52. Such attachment means may be in the form of conventional hook and loop type fasteners commercially known as Velcro such that actual displacement and/or removal of the tray elements 17 from the display platform means 16 or the base elements 22 from one another is hampered in that the hook and loop type fasteners must first be totally disengaged from one another. However, once such disengagement occurs, the individual mating contacts are separated and current ceases to flow through the primary conductor means 38 so as to activate the alarm assembly 32 in the manner set forth above.

It will therefore be seen that the nature of the present invention is set forth in detail in the preceding description. However, since certain changes may be made in the above construction without departing from the scope of the subject invention, it is intended that all matter contained in the above description or shown in the accompanying drawing shall be interpreted as illustrative and not in a limiting sense.

What is claimed is:

1. An alarm system of the type used in combination with a jewelry-type display case and primarily designed to prevent unathorized removal of articles from the interior thereof, said system comprising:

(a) base means dimensioned and configured for positioning on the interior of a display case and including at least one base element, (b) said base element including a substrate means and display platform means disposed in supported position on said substrate means, said display platform means structured to substantially define an exposed surface of said base means, (c) tray means structured to hold and display predetermined articles thereon and positioned in at least partially supported relation on said exposed surface, (d) circuit means mounted on said base means in communicating relation with said exposed surface and in interconnecting relation to said tray means, (e) said circuit means comprising conductor segment means secured to said tray means, a signal assembly, a power source, and further including conductor means interconnecting said latter elements in series with one another, (f) said tray means including said conductor segment means formed thereon and removably positionable in interconnection with said conductor means and electrical communication with said signal assembly and power source, said circuit means structured to cause activation of said signal assembly upon removal of said conductor segment means from interconnection with said conductor means and said tray means from said exposed surface of said display platform means, and said base means comprising a plurality of base elements disposable in interconnected, directly adjacent relation to one another, each base element including base contact means structured to define a position of said circuit means, said base contact means disposable for removable connection with the base contact means of a next adjacent base element.

2. An alarm system as in claim 1 wherein said tray means comprises a plurality of tray elements; said conductor segment means comprising a pluarlity of conductor segments, each tray element including one of said conductor segments mounted thereon, each conductor segment removably positioned in attachment with said conductor means and in series interconnectin with one another and said alarm assembly, said power source and said circuit means structured to activate said alarm assembly upon removal of any one of said conductor segments from said conductor means.

3. An alarm system as in claim 2 wherein each one of said conductor segments include a first contact pair, each contact thereof located at opposite ends of said one conductor segment; a plurality of second contact pairs disposed at spaced locations along the length of said conductor means, each of said plurality of second contact pairs defining gaps along the length of said conductor means and structured and dimensioned for interconnection with one of said conductor segments and associated first contact pairs.

4. An alarm system as in claim 3 wherein each of said plurality of conductor segments is structured to fill predetermined ones of said gaps through interconnection between correspondingly positioned first contact pairs and second contact pairs, said plurality of first contact pairs and said plurality of second contact pairs cooperatively structured to collectively define a completed series circuit.

5. An alarm system as in claim 4 further comprising attachment means secured to each contact of said plurality of first contact pairs and second contact pairs and structured for removable attachment between said conductor means and said conductor segments at each of said gaps formed in said conductor means.

6. An alarm system as in claim 5 wherein said attachment means comprises hook and loop type fasteners respectively secured to correspondingly positioned and securable contacts of said first and said second contact pairs.

7. An alarm system as in claim 3 wherein said display platform means is structured to establish communicating relation between tray elements mounted thereon and said circuit means, said conductor means positioned in substantially sandwiched relation between said display platform means and said substrate; aperture means integrally formed in said display platform means and extending therethrough in direct exposing relation to said conductor means, at least some of said tray elements mounted on said display platform means in aligned relation to said aperture means and in removable interconnection via associated conductor segments with said conductor means.

8. An alarm system as in claim 7 wherein said aperture means comprises a plurality of sockets integrally formed in said platform means in predetermined spaced relation to one another, each of said tray elements structured for aligned engagement with one of said sockets into engageable relation with said conductor means.

9. An alarm system as in claim 8 wherein at least one of said plurality of tray elements comprise mounting means each structured and disposed for aligned, substantially mating engagement with one of said plurality of sockets, said conductor segments associated with each of some of said tray elements secured to said mounting means and positionable into interconnecting engagement with said circuit means.

10. An alarm system as in claim 9 wherein said mounting means comprises a plug member substantially corresponding to a depth and peripheral dimension and configuration of each of said sockets and structured for selective positioning into and out of mating engagement on the interior thereof.

11. An alarm system as in claim 10 wherein one of said conductor segments is mounted on the undersurface of said plug members and is configured to extend substantially across a length thereof, the length of said one conductor segment being substnatially equal to each of said gaps in said conductor means.

12. An alarm system as in claim 1 wherein said circuit means further is structured to cause activation of said signal assembly upon disconnection between base contact means of adjacently positioned base elements and separation of interconnected base elements.

13. An alarm system as in claim 12 wherein said base contact means of at least one base element comprises a first base contact pair incluing two contact tabs disposed in spaced relation to one another along a lateral edge and extending outwardly from said lateral edge; a second base contact pair including two contact pads secured to an undersurface of said one base element in spaced relation to one another equal to the spacing of said contact tabs and adjacent an oppositely disposed and parallel lateral edge of said one base plate; correspondingly positioned first and second base contact pairs of adjacently positioned base elements disposed and structured for removable, mating engagement with one another.

14. An alarm system as in claim 12 wherein said platform means is mounted on each of said base elements, said platform means structured for communicating relation with said circuit means and said conductor means thereof positioned in substantially sandwiched relation between said substitute and said platform means, a number of said plurality of tray elements and associated ones of said conductor segments positionable on said platform means in removable engagement with said conductor means.

15. An alarm system as in claim 14 further comprising aperture means formed on each of said base elements and structured to establish communicating relation between an exposed surface of said platform means, said conductor means and said substrate means of said base element.

* * * * *